United States Patent [19]

Muraji et al.

[11] 4,377,174

[45] Mar. 22, 1983

[54] METHOD AND APPARATUS FOR APPLYING PERMANENT WAVE

[75] Inventors: Takashi Muraji, Nishinomiya; Hiroshi Kitamura, Osaka, both of Japan

[73] Assignee: SMK Industries, Osaka, Japan

[21] Appl. No.: 101,641

[22] Filed: Dec. 10, 1979

[30] Foreign Application Priority Data

Dec. 12, 1978 [JP] Japan ..... 53-155178
Dec. 12, 1978 [JP] Japan ..... 53-155179

[51] Int. Cl.[3] ..... A45D 1/00
[52] U.S. Cl. ..... 132/9
[58] Field of Search ..... 132/9; 34/97; 128/65

[56] References Cited

U.S. PATENT DOCUMENTS

| | | | |
|---|---|---|---|
| 2,188,924 | 2/1940 | Rockwood | 132/9 X |
| 2,189,430 | 2/1940 | McClure | 132/9 UX |
| 2,289,209 | 7/1942 | Reiches | 132/9 |
| 2,331,065 | 10/1943 | Willat | 132/9 X |
| 2,523,912 | 9/1950 | Melchior et al. | 132/9 |
| 2,855,939 | 10/1958 | Braskamp | 132/9 |
| 2,856,918 | 10/1958 | Kingery et al. | 132/9 X |
| 3,044,473 | 7/1962 | Cover | 132/9 |
| 3,177,868 | 4/1965 | Wallace et al. | 132/9 X |
| 3,343,530 | 9/1967 | Solos et al. | 132/9 X |
| 4,259,566 | 3/1981 | Kobayashi | 132/9 |

*Primary Examiner*—G. E. McNeill
*Attorney, Agent, or Firm*—Gabriel P. Katona

[57] ABSTRACT

A method and apparatus for applying a permanent wave, wherein the hair is wound on curlers, a first permanent wave applying solution is applied to the hair, a permanent wave applying hood is put on the head of the person, at least one of the steam blowing and heating devices installed in the permanent wave applying hood is actuated to cause the first solution to sufficiently wet and permeate the hair, and a second permanent wave applying solution is spread over the hair by a second solution spraying device installed in the permanent wave applying hood while at least one of the steam blowing and heating devices is actuated to cause the second solution to sufficiently permeate the hair of the person.

16 Claims, 5 Drawing Figures

METHOD AND APPARATUS FOR APPLYING PERMANENT WAVE

The present invention relates to a novel method and apparatus for applying a permanent wave, designed to automatically perform the permanent wave applying steps which have heretofore been manually performed.

More particularly, the present invention is an improvement on the invention described in U.S. patent application Ser. No. 948,891 filed Oct. 5, 1978.

In the original invention, an intermediate rinse spraying step was incorporated between the first liquid spraying step and the second liquid spraying step. As a result of our later research, however, it has been found that said intermediate rinse spraying step is utterly unnecessary. Accordingly, a first object of the invention is to provide a method and apparatus for satisfactorily applying a permanent wave while eliminating said intermediate rinse applying step.

Further, in the original invention, the construction of the permanent wave applying hood was rather inconvenient for the user. Accordingly, a second object of the invention is to improve the hood construction for easy and convenient use.

Further, in the original invention, there was a drawback that liquid chemicals for permanent wave were not uniformly sprayed over the user's hair in the permanent wave applying hood. Accordingly, a third object of the invention is to remedy this drawback.

A fourth object of the invention is to provide a construction which assures that the first and second permanent wave applying solutions will sufficiently wet and permeate the user's hair.

These and other objects of the invention will become more apparent from the following description of an embodiment of the invention with reference to the accompanying drawings, in which:

FIG. 2 is a diagrammatic structural view showing the relation between a steam feed construction and a hood section;

Figure 1:
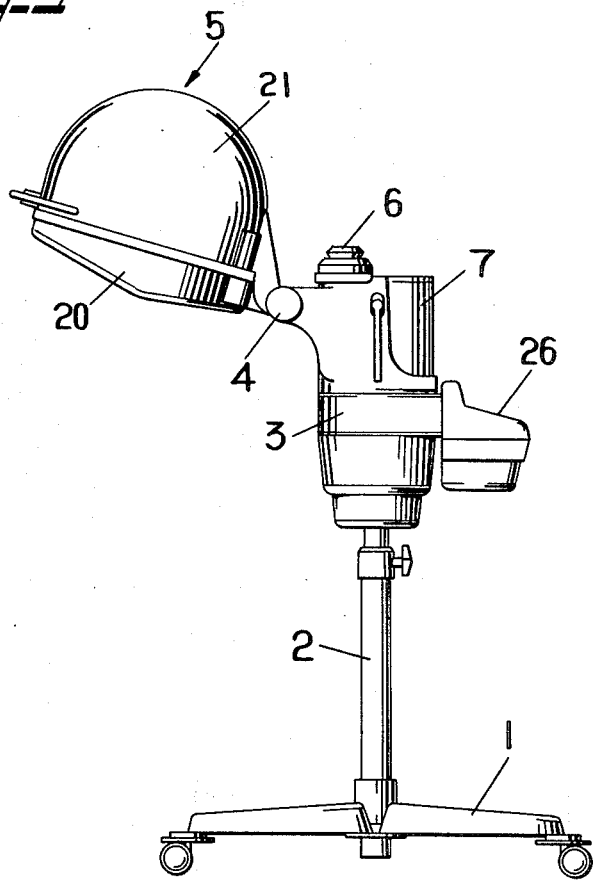
FIG. 1 is a diagrammatic external view of the entire apparatus of the invention.

A permanent wave applying apparatus shown in FIG. 1 comprises a stable leg 1, an extensible pillar 2 extending upwardly from said leg, an apparatus main body 3 mounted on top of said pillar, and a permanent wave applying hood 5 extending from said apparatus main body 3 through the intermediary of a joint 4. Removably housed in the apparatus main body 3 are a second solution storage bottle 6 and a steam producing water bottle 7 which are each filled with a required amount of corresponding liquid, the arrangement being such that, as shown in FIG. 2, with the driving of a liquid feed pump 9 by a motor 8, the second solution in the second solution storage bottle 6 is fed from said liquid feed pump 9 through a switching valve 10 and a liquid feed pipe 11 into the permanent wave applying hood 5 and, on the other hand, the water in the steam producing water bottle 7 is successively converted into steam by heater means 12, the steam being fed to the permanent wave applying hood 5 via a steam feed pipe 13. The numeral 14 designates a drain pipe for discharging the residual water from the heater means 12, said drain pipe having a valve 15 installed therein.

The switching valve 10 is connected to a drain collecting tank 16 through a drain pipe 17, the latter being connected to said liquid feed pump 9 and also to a drain pipe 18 through said switching valve 10. The drain pipe 17 is in communication with the drain pipe 18 at all times, but its communication with the liquid feed pump 9 is controlled by the operation of a valve spool 19 in such a manner that when it is desired to discharge the second solution from the liquid feed pump 9 after the use of the apparatus, the communication between the liquid feed pump 9 and the drain pipe 17 is established by the switching valve 10.

Figure 3:
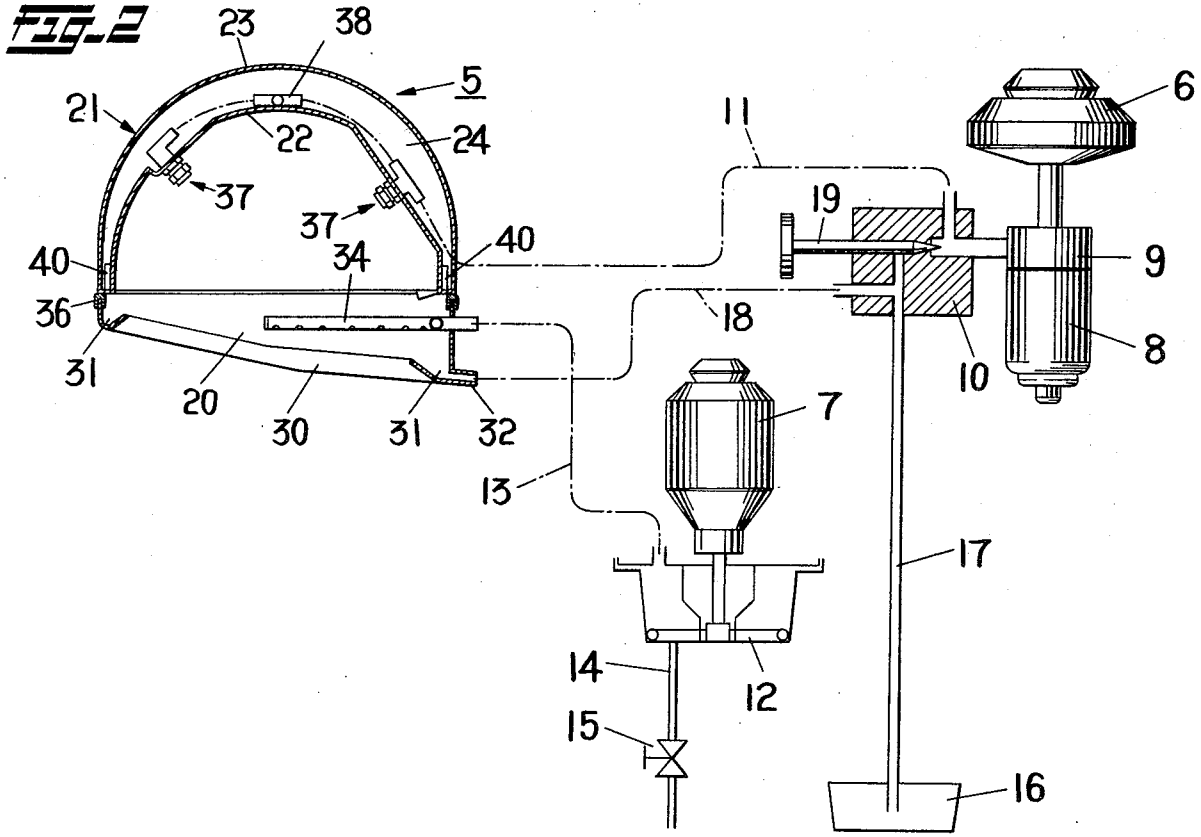
FIG. 3 is a side view, in longitudinal section, of said hood section.
Figure 3:
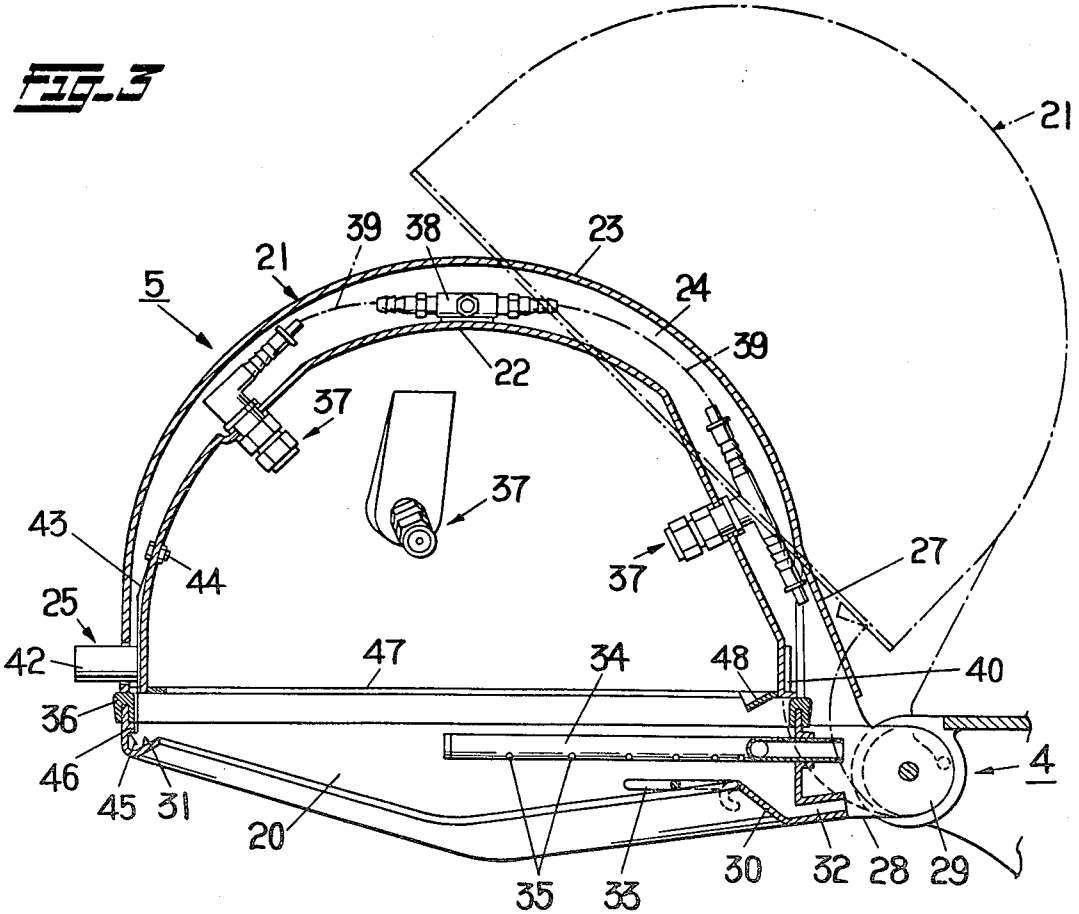
Figure 4:
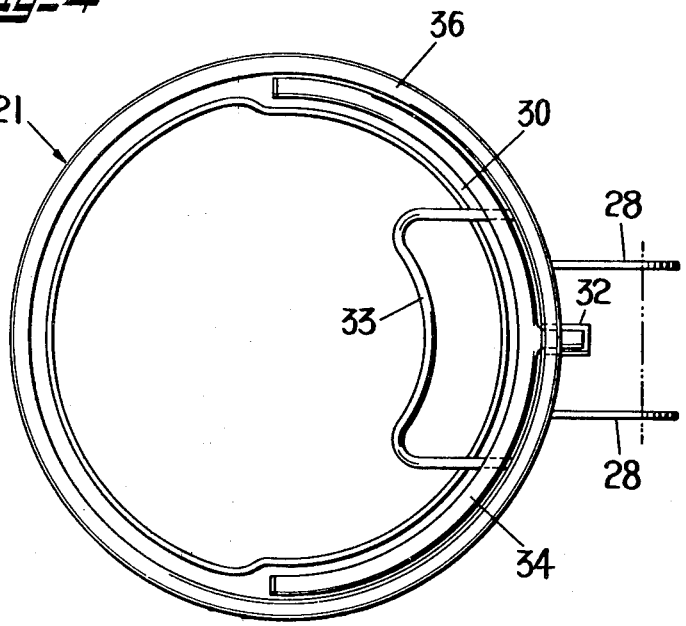
FIG. 4 is a plan view of a drain collecting ring.

The construction of the permanent wave applying hood 5 will now be described. As shown in FIGS. 3 and 4, the permanent wave applying hood 5 comprises a drain collecting ring 20 and a hood main body 21 placed over said drain collecting ring 20. The hood main body 21 is composed of inner and outer, substantially hemispherical caps 22 and 23, with a distributing pipe laying space 24 defined between said inner and outer caps 22 and 23. The drain collecting ring 20 and hood main body 21 are supported for individual vertical swing with respect to the apparatus main body 3. Further, they are held together by the joint 4 so that they are integrally vertically swingable with respect to the apparatus main body 3 while being locked together by locking means 25 to be later described.

Pairs of parallel support arms 27 and 28 respectively extend from the drain collecting ring 20 and the hood main body 21 and are pivotally supported at their free ends by a common joint shaft 29 horizontally supported in the apparatus main body 3. The entire lower peripheral edge of the drain collecting ring 20 is inwardly upwardly bent to form a gutter 30 whose upper surface defines an annular liquid collecting groove 31 extending along the drain collecting ring 20, so that the second solution sprayed within the hood main body 21 and the water which forms as a result of the steam condensing within the permanent wave applying hood 5 flow down along the inner surface of the inner cap 22 until they are collected in the liquid collecting groove 31. Projecting from the rear portion of the drain collecting ring 20 is a liquid discharging mouthpiece 32 which communicates with the liquid collecting groove 31 and to which the previously described drain pipe 18 is connected.

A head support bar 33 is installed inside the drain collecting ring 20 for supporting the back of the user's head during the use of the apparatus. The numeral 34 designates a steam blowing pipe which is arcuately bent above the head support bar 33 and along the inner surface of the ring 20 and to which the previously described steam feed pipe 13 is connected. Therefore, the steam fed from the apparatus main body 3 side is blown into the permanent wave applying hood 5 through a number of small holes 35 formed in the steam blowing pipe 34.

A seal 36 of rubber or other elastic material fitted on the upper peripheral edge of the drain collecting ring 20 assures fluid tightness when the hood main body 21 is integrally fixed to the drain collecting ring 20 by the locking means 25. Thus, the seal 36 prevents the leakage of the second solution and steam. The hood main body 21 has second-solution blowing nozzles 37 disposed at at least 4 positions on the inner cap 22 so as to direct the second solution toward the center of said cap 22.

The liquid feed pipe 11 described above is inserted in the distributing pipe laying space 24 between the inner and outer caps 22 and 23 and is connected to the individual nozzles 37 through distributing joints 38 and distributing pipes 39. Thus, as the liquid feed pump 9 is driven by the motor 8, the second solution is fed to the nozzles 37, through which it is sprayed into the hood main body 21.

Figure 5:
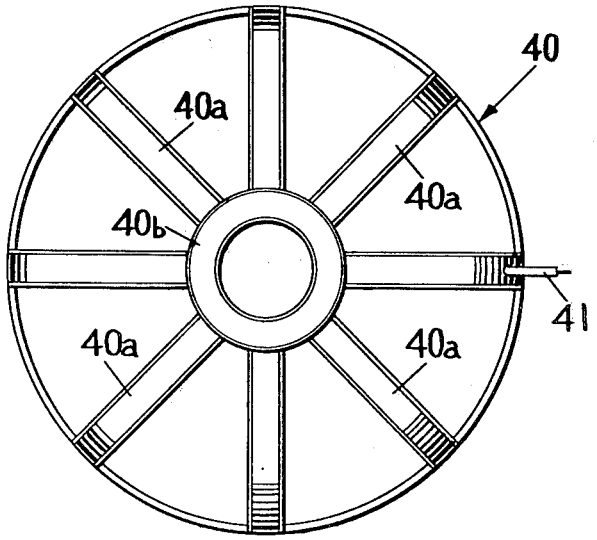
FIG. 5 is an external view of a thermostatic heater.

Fitted over the outer surface of the inner cap 22 is a thermostatic heater 40 as shown in FIG. 5 which is connected through a cord 41 to a control box 26 associated with the apparatus main body 3, the arrangement being such that when the thermostatic heater 40 is energized, the atmosphere in the hood main body 21 is maintained at a required temperature (30° C.). The thermostatic heater 40 is composed of band-like portions 40*a* radially extending from the apex of the inner cap 22 and an annular band-like portion 40*b* interconnecting the ends of said band-like portions 40*a*.

As shown in FIG. 3, at the front lower edge of the hood main body 21, an unlocking button 42 extends from the distributing pipe laying space 24 through the outer cap 23. The unclocking button 42 is fixed to the intermediate portion of a leaf spring 43 whose upper end is fixed to the inner cap 22 by a screw 44 and whose lower end, which extends downwardly beyond the hood main body 21, is formed with an anchor pawl 45 which is adapted to engage a stop projection 46 on the ring 20 when the hood main body 21 and the drain collecting ring 20 are put together, whereby the hood main body 21 and the drain collecting ring 20 are locked together. It will be understood that the unlocking can be effected by pushing the unlocking button 42.

Designated at 47 in FIG. 3 is a drain collecting plate fixed at its rear lower region to the inside of the inner cap 22 by a screw to receive drain flowing down along the inner cap 22 upon opening of the hood main body 21 for the purpose of a curl test to be later described, the drain thus received being stored in a region nearer to the center of rotation of the hood main body 21. Further, when the hood main body 21 is closed again, said liquid collecting plate also serves to transfer the drain from the liquid collecting portion to the liquid collecting groove 31 of the drain collecting ring 20. The use of said drain collecting plate 47 is advantageous since it prevents the drain from accidental dripping to stain the floor when the hood main body is opened.

In using the permanent wave applying apparatus thus constructed, first, tufts of the user's hair are wound in successive required amounts on curlers and then the first solution is applied thereto or, alternatively, the first solution is applied and then the hair is wound on curlers. Subsequently, the permanent wave applying hood 5, with the drain collecting ring 20 and hood main body 21 locked together by the locking means 25, is once raised with respect to the apparatus main body 3 and then lowered to be put on the user's head, whereupon the permanent wave applying apparatus is driven. As the apparatus is driven, the thermostatic heater 40 is energized to maintain the atmosphere in the permanent wave applying hood 5 at 20° C.–30° C., preferably at 30° C. This heat serves to effectively enhance the attachment of the first solution to the hair.

In this case, depending upon the kind of the first solution, instead of energizing the thermostatic heater 40, the steam generated by the heater means 12 may be fed via the steam feed pipe 13 to the permanent wave applying hood 5, where it is blown through the steam blowing pipe 34 to wet and permeate the hair. The temperature of the atmosphere in the permanent wave applying hood 5 maintained by this steam blow is 40° C.–55° C., preferably 50° C.

Subsequent to the first solution wetting and permeating step, the liquid feed pump 9 is driven to feed the second solution through the switching valve 10 and liquid feed pipe 11 to the permanent wave applying hood 5, where it is sprayed through the nozzles 37 over the user's hair. During the second solution wetting and permeating step, the energization of the thermostatic heater 40 or the blowing of the steam through the steam blowing pipe 34 may be cut off. Preferably, the first solution wetting and permeating step should proceed concurrently with the second solution wetting and permeating step.

When the second solution has sufficiently wetted and permeated the user's hair under the action of the heat from the steam blown from the steam blowing pipe 34 or the heat from the thermostatic heater 40, the operation of the permanent wave applying apparatus is stopped.

During the steps described above, the drain collected in the drain collecting ring 20 flows through the drain discharge pipe 18 and the liquid discharge pipe 17 into the drain collecting tank 16 for collection therein. Thus, according to the permanent wave applying apparatus of the invention, as is clear from the foregoing description, the permanent wave applying operation, excluding the winding on curlers and the application of the first solution, is automated to a substantial degree.

The period of time of energization of the thermostatic heater (or the first solution time) for enhancing the attachment of the chemical liquid to the hair, though varying with the nature of the hair being treated, is preferably from 12 minutes to 15 minutes, while the second solution is preferably intermittently sprayed several times. The period of time for enhancing the attachment of the second solution to the hair (or the second solution time) is preferably about 15 minutes. The second solution is sprayed several times, each by 60–80 cc for 3–6 seconds. Such first solution time and second solution time will be preset by timer means contained in the control box 26 affixed to the apparatus main body 3, so that automatic operation will be performed.

Further, the invention contemplates incorporating an arrangement comprising a buzzer or other signaling device which, upon termination of the first solution time, emits a termination signal. Such arrangement is useful since just prior to moving to the second solution time, it is possible to start a curl test at said termination signal. The term "curl test" means checking on the degree of the elasticity of the waves (or the quality of the curls) attained by the action of the first solution, prior to spraying the second solution. According to the invention, the curl test can be made by pushing the unlocking button 42 to remove the lock between the drain collecting ring 20 and the hood main body 21, and raising the hood main body 21 alone to a phantom line position in FIG. 3 to expose the user's head to be ready for checking on the quality of the curls. If the quality of the curls is found to be poor, the first solution is sprayed again over the hair, while the program is adjusted to prolong the first solution time by the control box 26. Therefore, unlike the prior art procedure, there is no inconvenience of having to remove the user's head from the permanent wave applying hood 5 for the purpose of making a curl test.

In addition, according to the invention, the first solution time and the second solution time may be automatically continuously operated. Alternatively, they may be separately operated to allow for a curl test. These may be arranged to make selections by known electronic techniques.

As has been fully described so far, with the permanent wave applying hood put on the user's head having the hair wound on curlers and the first solution applied to the hair, the step of actuating the thermostatic heating means or the steam blowing means or both to maintain the atmosphere in the permanent wave applying hood at a fixed temperature to enhance the attachment of the first solution to the hair, and the step of subsequently blowing the second solution by the second solution spraying means and actuating the steam blowing means or the thermostatic heating means or both to enhance the attachment of the second solution to the hair are performed. Therefore, a permanent wave can be automatically applied without having to remove the head from the permanent wave applying hood, so that the operation can be made greatly efficient and the time required for applying a permanent wave can be greatly reduced. Moreover, since the permanent wave applying method is automatically performed by mechanical operation, even a layman can easily perform the method, without requiring any high skill.

What is claimed is:

1. A method of applying a permanent wave comprising: a first solution applying step including winding the user's hair on curlers, applying the first solution to the user's hair and putting a permanent wave applying hood on the user's head; a first solution permeating step including actuating at least one of steam blowing and heating means installed in said permanent wave applying hood to cause the first solution to sufficiently permeate the user's hair; testing the elasticity of the curls of the user's hair prior to the spraying of any further solutions and without removing the user's head from the entire hood; subsequently spraying a second permanent wave applying solution over the hair within the permanent wave applying hood; and a second solution permeating step including actuating at least one of said steam blowing and heating means concurrently with said second solution spraying step to cause the second solution to sufficiently permeate the user's hair.

2. A method of applying a permanent wave as set forth in claim 1, wherein the temperature of the atmosphere in the hood is maintained by said heating means during said first and second solution permeating steps at about 30° C.

3. A method of applying a permanent wave as set forth in claim 1, wherein the temperature of the atmosphere in the hood is maintained by said steam blowing means during the first and second solution permeating steps at 40° C.–55° C.

4. A method of applying a permanent wave as set forth in claim 1, wherein the spraying operation in said second solution spraying step is performed intermittently.

5. A method of applying a permanent wave as set forth in claim 4, wherein the intermittent spraying operation in said second solution spraying step is performed several times each with an amount of 60–80 cc continuously for 3–6 seconds.

6. A permanent wave applying apparatus comprising: a main body having steam blowing means and second solution feed means; and a permanent wave applying hood having a hood main body and a drain collecting ring removably attachable to said hood main body, means pivotally connecting the hood main body and the drain collecting ring about a common joint to the main body, locking means disposed between the hood main body and the drain collecting ring for releasably locking them together, and wherein said hood main body is provided with a plurality of second solution spraying nozzles and said drain collecting ring is provided with a steam blowing pipe.

7. A permanent wave applying apparatus as set forth in claim 6, wherein said hood main body comprises an inner and an outer cap with a clearance defined therebetween, a distributing joint and distributing pipes connected to the second solution spraying nozzles and disposed in said clearance.

8. A permanent wave applying apparatus as set forth in claim 2, wherein the inner cap has heating means thereon.

9. A permanent wave applying apparatus as set forth in claim 8, wherein the main body further comprises a control box for automatically controlling the steam blowing means, second solution feeding means and the heating means.

10. A permanent wave applying apparatus as set forth in claim 6, wherein said locking means comprises a leaf spring having one end thereof fixed to the hood main body and the other end configured for engagement with the drain collecting ring and an unlocking button for pushing said leaf spring against its spring force.

11. A permanent wave applying apparatus as set forth in claim 7, further comprising a liquid feed pipe which connects the second solution feeding means to the distributing pipe and a flow controlling and switching valve for the liquid feed pipe.

12. A permanent wave applying apparatus as set forth in claim 11, wherein said switching valve is connected to a liquid discharging pipe leading to a drain storage tank.

13. A permanent wave applying apparatus as set forth in claim 6, wherein the drain collecting ring has an annular liquid collecting groove along its lower edge which leads to a drain storage tank.

14. A permanent wave applying apparatus as set forth in claim 13, wherein the hood main body has a drain collecting plate along its lower edge.

15. A permanent wave applying apparatus as set forth in claim 14, wherein the drain collecting plate has a liquid discharging portion toward the annular liquid collecting groove of the ring when the hood main body is substantially horizontally placed on the drain collecting ring.

16. A permanent wave applying apparatus as set forth in claim 6, wherein the drain collecting ring has a bar which supports the back of the head of the user.

* * * * *